US009227195B2

(12) United States Patent
Qi et al.

(10) Patent No.: US 9,227,195 B2
(45) Date of Patent: Jan. 5, 2016

(54) SCRAPPED GLASS PULVERIZING DEVICE

(71) Applicant: SHENZHEN CHINA STAR OPTOELECTRONICS TECHNOLOGY CO., LTD, Shenzhen (CN)

(72) Inventors: Minghu Qi, Shenzhen (CN); Chunhao Wu, Shenzhen (CN); Kunhsien Lin, Shenzhen (CN); Zenghong Chen, Shenzhen (CN); Zhenhua Guo, Shenzhen (CN); Yunshao Jiang, Shenzhen (CN)

( * ) Notice: Subject to any disclaimer, the term of this patent is extended or adjusted under 35 U.S.C. 154(b) by 326 days.

(21) Appl. No.: 13/699,624

(22) PCT Filed: Oct. 25, 2012

(86) PCT No.: PCT/CN2012/083499

§ 371 (c)(1),
(2) Date: Nov. 22, 2012

(87) PCT Pub. No.: WO2014/056261

PCT Pub. Date: Apr. 17, 2014

(65) Prior Publication Data

US 2014/0097279 A1 Apr. 10, 2014

(30) Foreign Application Priority Data

Oct. 9, 2012 (CN) ..... 2012 1 0379919

(51) Int. Cl.

| | |
|---|---|
| ***B02C 23/00*** | (2006.01) |
| ***B02C 19/00*** | (2006.01) |
| ***B02C 1/14*** | (2006.01) |
| ***B02C 4/02*** | (2006.01) |

(Continued)

(52) U.S. Cl.

CPC ..... *B02C 19/0056* (2013.01); *B02C 1/14* (2013.01); *B02C 4/02* (2013.01); *B02C 13/20* (2013.01); *B02C 19/0068* (2013.01); *B02C 19/0081* (2013.01); *B02C 19/0087* (2013.01); *B02C 23/02* (2013.01); *B02C 2013/28636* (2013.01)

(58) Field of Classification Search

CPC ..... B02C 19/0087; B02C 19/0081; B02C 19/0068; B02C 19/00; B02C 1/00

USPC ..... 241/84, 84.4, 95, 99, 186.4, 152.2, 100, 241/78, 157

See application file for complete search history.

(56) References Cited

U.S. PATENT DOCUMENTS 3,709,441 A * 1/1973 Hessner et al. ..... 241/94
5,082,187 A * 1/1992 Kirchhoff et al. ..... 241/84

(Continued)

FOREIGN PATENT DOCUMENTS

CN 2609660 Y 4/2004
CN 200981004 Y 11/2007

(Continued)

OTHER PUBLICATIONS

Zhang Jin, the International Searching Authority written comments, Jul. 2013, CN.

*Primary Examiner* — Faye Francis

(57) ABSTRACT

A scrapped glass pulverizing device includes a vibration crushing device. The vibration crushing device includes a vibration hammer, a vibration generator that controls vibration of the vibration hammer up and down, and a crushing platform arranged below the vibration hammer and supports scrapped glass.

9 Claims, 3 Drawing Sheets

(51) Int. Cl.

| | |
|---|---|
| ***B02C 23/02*** | (2006.01) |
| ***B02C 13/20*** | (2006.01) |
| *B02C 13/286* | (2006.01) |

(56) References Cited

U.S. PATENT DOCUMENTS

| | | | | |
|---|---|---|---|---|
| 5,246,174 | A | 9/1993 | Vitunac et al. | |
| 5,456,738 | A * | 10/1995 | Gil | 75/403 |
| 5,743,473 | A | 4/1998 | Gregg | |
| 2009/0127361 | A1 | 5/2009 | Kelly et al. | |
| 2010/0108792 | A1 * | 5/2010 | Price | 241/101.5 |

FOREIGN PATENT DOCUMENTS

| | | | |
|---|---|---|---|
| CN | 101327456 | A | 12/2008 |
| CN | 101837307 | A | 9/2010 |
| DE | 7222313 | U | 1/1973 |
| JP | 61-171553 | A | 8/1986 |
| JP | 7-214391 | A | 8/1995 |
| JP | 2001-187378 | A | 7/2001 |
| JP | 2002-186952 | A | 7/2002 |
| JP | 2011-131184 | A | 7/2011 |

* cited by examiner

--Prior Art--

SCRAPPED GLASS PULVERIZING DEVICE

The present disclosure relates to manufacture field of liquid crystal displays (LCDs), and more particularly to a scrapped glass pulverizing device.

BACKGROUND

As an essential component of a liquid crystal display (LCD) device, an LCD panel includes two glass substrates which are oppositely arranged.

In previous LCD panel manufacturing methods, a scrapped glass is produced and disposed. In the previous LCD panel manufacturing methods, glass substrates are difficult to carry because both length and width of the glass substrates (one glass substrate can produce a plurality of LCD panels are large. As shown in FIG. 1, a large piece of scrapped glass 104 is cut into pieces by a cutting machine manually or a glass cutter 117 on a cutting platform 111 to facilitate carrying and subsequent disposing. However, efficiency of disposing such defective product is low, and operation of cutting the scrapped glass 104 is dangerous.

SUMMARY

In view of the above-described problems, the aim of the present disclosure is to provide a scrapped glass pulverizing device with high efficiency and safety.

The aim of the present disclosure is achieved by the following technical scheme. A scrapped glass pulverizing device, comprising:

a vibration crushing device which is configured with a vibration hammer, a vibration generator that drives the vibration hammer to vibrate up and down, and a crushing platform; the crushing platform is arranged below the vibration hammer and supports scrapped glass, the crushing platform is configured with blanking holes arranged in an action zone of the vibration hammer, the blanking holes are arranged in a honeycomb net shape on the crushing platform, the blanking holes are aligned with a lower part of a hammering end of the vibration hammer, and a size of the blanking holes is more than a maximum width of the hammering end of the vibration hammer;

a secondary pulverizing device is arranged below the crushing platform and pulverizes the scrapped glass pieces generated by the vibration crushing device and discharged into the secondary pulverizing device through the blanking holes; the secondary pulverizing device comprises two crushing gears arranged in parallel and rotated in opposite direction, and the crushing teeth of the crushing gears are mutually inserted into grooves between the crushing teeth of the crushing gears at junctions of the two crushing gears;

a scrapped glass feeding device is configured with a conveyor belt engaged with a feeding side of the crushing platform, and the scrapped glass is fed onto the crushing platform by the conveyor belt;

an auxiliary conveyor wheel; the auxiliary conveyor wheel is arranged at an edge of the feeding side of the crushing platform and presses on the scrapped glass and provides an auxiliary force to feed the scrapped glass by rotation of the auxiliary conveyor wheel; and a collection container collects pulverized glass.

The aim of the present disclosure is further achieved by the following technical scheme. A scrapped glass pulverizing device comprises a vibration crushing device that comprises a vibration hammer, a vibration generator that drives the vibration hammer to vibrate up and down, and a crushing platform arranged below the vibration hammer and supported scrapped glass.

In one example, the crushing, platform is configured with blanking holes arranged in an action zone of the vibration hammer. The scrapped glass piecesis generated by the vibration crushing device and is directly discharged through the blanking holes, thereby facilitating collecting the scrapped glass pieces.

In one example, the blanking holes are arranged in a honeycomb net shape on the crushing platform. The blanking holes arranged in a honeycomb net shape are equal in size, which enables the size of the scrapped glass pieces to be uniform, and the blanking holes are arranged in a honeycomb net shape, which makes the scrapped glass pieces discharge through the blanking holes.

In one example, the blanking holes are aligned with a lower part of a hammering end of the vibration hammer, and a size of the blanking holes is more than a maximum width of the hammering end of the vibration hammer. The hammering end of the vibration hammer can drop in the blanking hole, so that smaller the scrapped glass pieces generated when hammering the scrapped glass by the vibration hammer can be directly discharged through the blanking holes.

In one example, the scrapped glass pulverizing device further comprises a secondary pulverizing device that pulverizes the scrapped glass pieces generated by the vibration crushing device. By being crushed twice, the scrapped glass become smaller, thereby facilitating subsequent transportation and disposing process.

In one example, the secondary pulverizing device comprises two crushing gears arranged in parallel and rotated in opposite direction, and crushing teeth of the crushing gears are mutually inserted into grooves between the crushing teeth of the crushing gears at junctions of the two crushing gears. The scrapped glass s are extruded in the grooves between teeth and then crushed again into scraps of smaller diameter by the crushing gears with crushing teeth which are mutually inserted into the grooves between the crushing teeth of the crushing gears, thereby facilitating transportation and subsequent disposing.

In one example, the crushing platform is configured with blanking holes arranged in a action zone of the vibration hammer the blanking holes are arranged in the crushing platform in a honeycomb net shape, the blanking holes are aligned with a lower part of a hammering end of the vibration hammer, and a size of the blanking holes is more than a maximum width of the hammering end of the vibration hammer; the secondary pulverizing device is arranged below the crushing platform, and the scrapped glass generated by the vibration crushing device and discharged into the secondary pulverizing device through the blanking holes. Because the secondary pulverizing device is arranged below the blanking holes, it is not necessary to collect the scrapped glass pieces during the primary crushing, thereby increasing the efficiency and reducing the components of the pulverizing device.

In one example, the scrapped glass pulverizing device is further configured with a collection container collects the pulverized glass crushed. The scrapped glass pieces are directly collected by the collection container under the secondary pulverizing device, thereby facilitating loading the scrapped glass pieces.

In one example, the scrapped glass pulverizing device further comprises a scrapped glass feeding device; the scrapped glass feeding device is configured with a conveyor belt engaged with a feeding side of the crushing platform, and the scrapped glass is fed onto the crushing platform by the conveyor belt. The scrapped glass is fed into the vibration crushing device by the feeding device, which make it safer and more efficiency.

In one example, an edge of the feeding side of the crushing platform is configured with an auxiliary conveyor wheel, and the auxiliary conveyor wheel is pressed on the scrapped glass and provides an auxiliary force to feed the scrapped glass by rotation of the auxiliary conveyor wheel. The feeding reliability is improved by pressing the scrapped glass through the auxiliary conveyor wheel.

In the present disclosure, the scrapped glass is crushed by the up and down vibration of the vibration hammer of the vibration crushing device, and then large pieces of the scrapped glass is quickly crushed into smaller the scrapped glass pieces, thereby ficilitating carrying and subsequent disposing. In addition, because the vibration hammer of the vibration crushing device quickly generates a plurality of cracks in the scrapped glass and then crushes into a plurality of pieces during vibration, efficiency is significantly increased relative to typical cutting modes of the the scrapped glass. The scrapped glass can be crushed into smaller the scrapped glass pieces by the vibration hammer, which is faster than cutting scrapped glass of the same size using the typical cutting modes. Moreover, because the vibration hammer is operated to vibrate without manual operation of the vibration crushing device directly, safety is significantly increased.

Legends: 100. vibration crushing device; 200. secondary pulverizing device; 300. feeding device; 400. collection container; 101. vibration generator; 102. vibration hammer; 103. auxiliary conveyor wheel; 104. scrapped glass; 105. crushing platform; 106. blanking hole; 111. cutting platform: 117. glass cutter; 210. crushing gear; 211. axis; 212. gear roller; 213. crushing tooth; 214. groove; 301. conveyor belt.

DETAILED DESCRIPTION

The present disclosure will further be described in detail in accordance with the figures and the examples.

Figure 1:
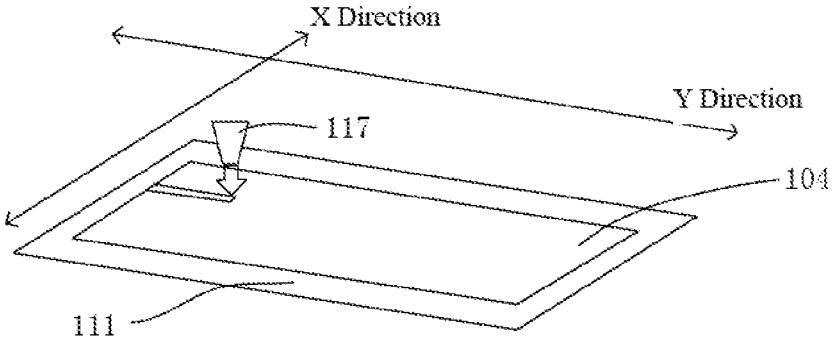
FIG. 1 is a schematic diagram of a typical method for disposing a scrapped glass.
Figure 2:
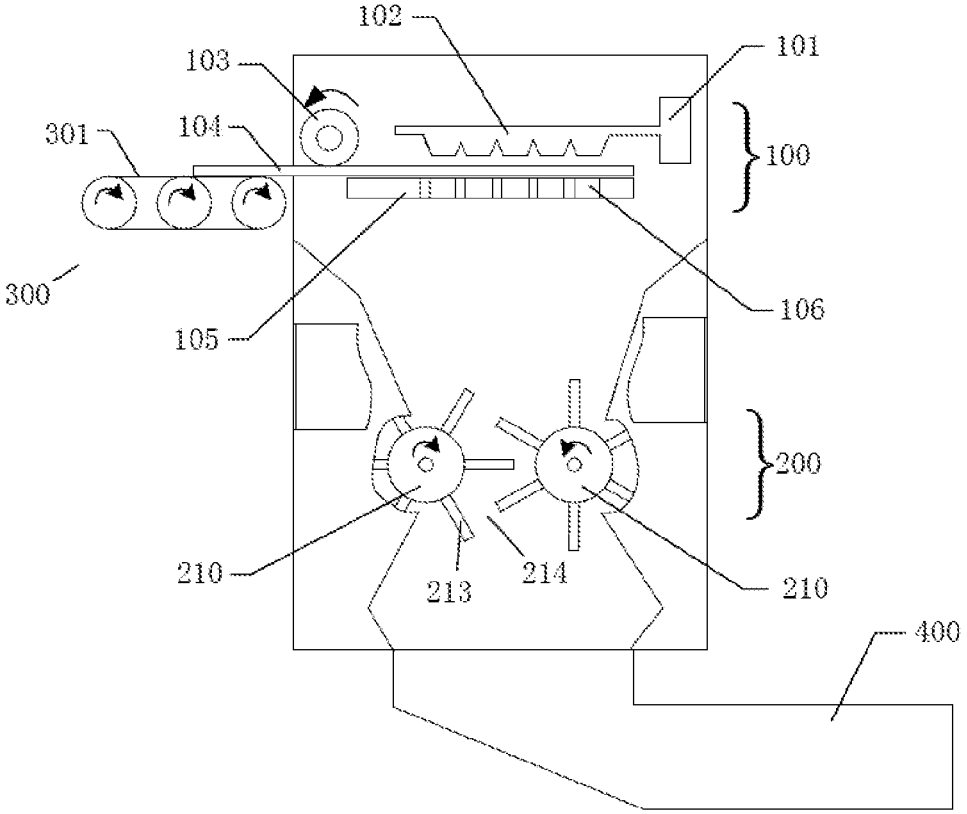
FIG. 2 is a simplified structural diagram of a scrapped glass pulverizing device of an example of the present disclosure.

As shown in FIG. 2, a scrapped glass pulverizing device of the present disclosure comprises a vibration crushing device 100. The vibration crushing device 100 comprises a vibration hammer 100 that directly impacts scrapped glass, a vibration generator 101 that drives the vibration hammer 102 to vibrate up and down, and a crushing platform 105 that supports the scrapped glass 104. The scrapped glass 104 is crushed by the up and down vibrations of the vibration hammer 102 of the vibration crushing device 100, where large pieces of the scrapped glass are quickly crushed into smaller scrapped glass pieces, thereby facilitating carrying and subsequent disposing. In addition, because the vibration hammer 102 of the vibration crushing device 100 quickly generates a plurality of cracks in the scrapped glass 104, which is then crushed into a plurality of pieces during vibration, causing efficiency to be significantly increased relative to typical cutting modes of the scrapped glass. The scrapped glass 104 can be crushed into smaller scrapped glass pieces by the vibration hammer 102, which is faster than cutting scrapped glass of the same size using the typical cutting modes. Moreover, because the vibration hammer 102 is operated to vibrate without manual operation of the crushing device directly, safety is significantly increased.

Figure 3:
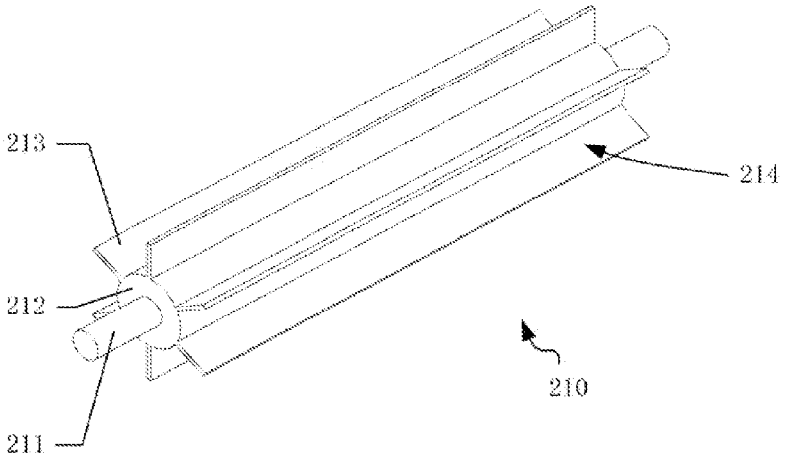
FIG. 3 is a simplified structural diagram of a crushing gear of secondary pulverizing device of an example of the present disclosure.

To pulverize the scrapped glass pieces generated by the vibration hammer 102 hammering the scrapped glass into even smaller sizes, the scrapped glass pulverizing device is further configured with a secondary scrapped glass pulverizing device 200. The secondary scrapped glass pulverizing device 200 is different from the vibration crushing device 100 in that the secondary scrapped glass pulverizing device 200 is configured with two crushing gears 210 arranged in parallel and rotated in opposite direction. As shown in FIG. 3, the crushing gear 210 comprises an axis 211, a gear roller 212, crushing teeth 213 arranged on the gear roller 212, and grooves 214 between the crushing teeth 213 arranged between the crushing teeth 213. The crushing teeth 213 of the crushing gears 210 are mutually inserted into the grooves 214 between the crushing teeth 213 of the crushing gears at junctions of the two crushing gears 210, where the scrapped glass pieces are extruded in the grooves 214 and pulverized by the crushing teeth 213 into smaller size scrapped glass pieces.

The crushing platform 105 of the vibration crushing device 100 is configured with blanking holes 103 in an action zone of the vibration hammer 102, and the scrapped glass pieces generated by the vibration hammer 102 hammering the scrapped glass and directly discharged through the blanking holes 106 without using a cleaning mechanism on the crushing platform 105, which is convenient and efficient. In the example, the secondary pulverizing device 200 is arranged directly below the blanking holes 106. Thus, the scrapped glass pieces first generated by the vibration crushing device 100 are directly discharged on the secondary pulverizing device 200 without being collected or transmitted to the secondary pulverizing device 200. Such arrangement can save design cost of the pulverizing device, and can increase processing efficiency.

Figure 4:
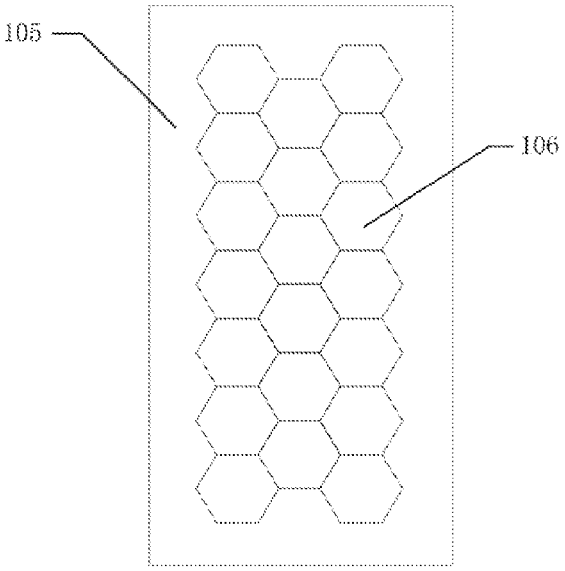
FIG. 4 is a simplified structural diagram of a blanking hole structure of a crushing platform of an example of the present disclosure.

As shown in FIG. 4, the blanking holes 106 are arranged in a honeycomb net shape on the crushing platform 105. Thus, the blanking holes are uniformly arranged in the crushing platform 105. Moreover, the honeycomb net shape arrangement enables size of the blanking holes to be equal in size, and then enables size of the scrapped glass pieces to be more uniform. The uniformly distributed blanking holes 106 are more beneficial to the scrapped glass pieces to be discharged through the blanking holes 106.

The vibration crushing device 100 and the secondary pulverizing device 200 are arranged in a casing, a collection container 400 that collects the pulverized glass is arranged on a lowermost part of the casing, and the collection container 400 is arranged just below the secondary pulverizing device 200 to directly collect the pulverized glass second pulverized by the secondary pulverizing device 200. The container collects directly the pulverized glass, thereby needing no manual collection after pulverization and facilitating load and transmission.

A feeding side of the vibration crushing device 100 is further configured with a scrapped glass feeding device 300, and the scrapped glass feeding device 300 is configured with a conveyor belt 301 engaged with a feeding side of the crushing platform 105. The scrapped glass 104 is fed into the crushing platform 105 by the conveyor belt 301. The scrapped glass is fed into the vibration crushing 100 by the feeding device 300 thereby preventing workers from approaching the vibration crushing device 100, which makes it safer and more efficient. An edge of the feeding side of the crushing platform 105 is further configured with an auxiliary conveyor wheel 103, and the auxiliary conveyor wheel 105 is pressed on the scrapped glass 104 and provides an auxiliary force to feed the scrapped glass by rotation of the auxiliary conveyor wheel 105. Feeding reliability is improved by pressing the scrapped glass through the auxiliary conveyor wheel 103.

Figure 5:
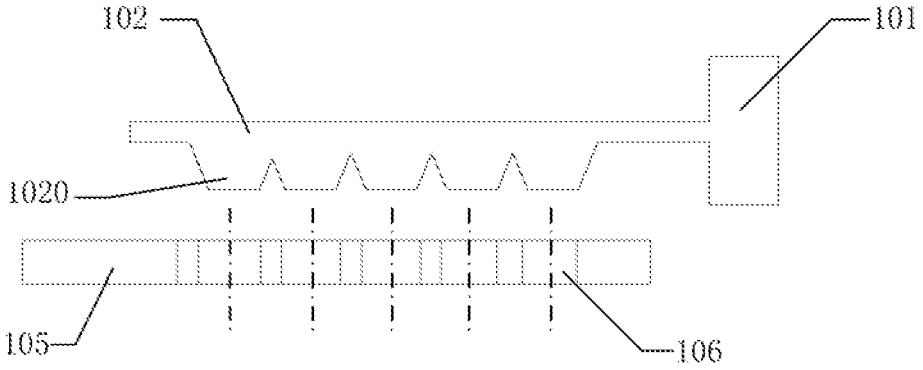
FIG. 5 is a simplified structural diagram of a vibration crushing device of an example of the present disclosure.

In the example, the secondary pulverizing device 200 is not limited to the crushing mechanism formed by the crushing gears 210, and can use other pulverization mechanisms using a crushing hammer, an extruding mechanism, and the like. The vibration crushing device 100 with a large pulverizing area is required for primary pulverization. As shown in FIG. 5, the vibration hammer 102 of the vibration crushing device 100 comprises a plurality of hammering structures 1020. Thus, a large area of the scrapped glass 104 or the entire scrapped glass 104 can be hammered each time. Crushing efficiency is high, which cannot be achieved by the secondary crushing device 200. The hammering structures 1020 are arranged on the vibration hammer 102 in accordance with the arrangement of the blanking holes 106, so that the blanking holes 106 are aligned with a lower part of a hammering end of the vibration hammer 102, and the size of the blanking holes 106 is more than a maximum width of the hammering end of the vibration hammer 102. The hammering end of the vibration hammer 102 can drop in the blanking hole 106, so that smaller scrapped glass pieces generates when the vibration hammer 102 hammers the scrapped glass 104 can be discharged through the blanking holes 106.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

The invention claimed is:

1. A scrapped glass pulverizing device, comprising:

a vibration crushing device configured with a vibration hammer, a vibration generator, and a crushing platform; wherein the crushing platform is arranged below the vibration hammer and supports scrapped glass; wherein the vibration drives the vibration hammer to vibrate up and down; wherein the crushing platform is configured with blanking holes arranged in an action zone of the vibration hammer, the blanking holes are arranged in a honeycomb net shape on the crushing platform and aligned with a lower part of a hammering end of the vibration hammer, and wherein size of the blanking holes is more than a maximum width of the hammering end of the vibration hammer;

a scrapped glass feeding device configured with a conveyor belt engaged with a feeding side of the crushing platform, and the scrapped glass is fed into the crushing platform by the conveyor belt;

a secondary pulverizing device arranged below the crushing platform and pulverized scrapped glass pieces generated by the vibration crushing device and discharged into the secondary pulverizing device through the blanking holes; the secondary pulverizing device comprises two crashing gears arranged in parallel and rotated in opposite direction, and wherein crushing teeth of the crushing gears are mutually inserted into grooves between the crushing teeth of the crushing gears at junctions of the two crushing gears;

an auxiliary conveyor wheel arranged at an edge of the feeding side of the crushing platform and pressed on the scrapped glass and provided an auxiliary force to feed the scrapped glass to the crushing platform by rotation of the auxiliary conveyor wheel; and a collection container collects the pulverized glass.

2. A scrapped glass pulverizing device, comprising:

a vibration crushing device that comprises a vibration hammer, a vibration generator that drives the vibration hammer to vibrate up and down, and a crushing platform; wherein the crushing platform is arranged below the vibration hammer and supports scrapped glass, wherein the scrapped glass pulverizing device further comprises a scrapped glass feeding device; the scrapped glass feeding device is configured with a conveyor belt engaged with a feeding side of the crushing platform, and the scrapped glass is fed into the crushing platform by the conveyor belt, wherein an edge of the feeding side of the crushing platform is configured with an auxiliary conveyor wheel, and the auxiliary conveyor wheel is pressed on the scrapped glass and provides an auxiliary force to feed the scrapped glass by rotation of the auxiliary conveyor wheel.

3. The scrapped glass pulverizing device of claim 2, wherein the crushing platform is configured with blanking holes arranged in an action zone of the vibration hammer.

4. The scrapped glass pulverizing device of claim 3, wherein the blanking holes are arranged in a honeycomb net shape in the crushing platform.

5. The scrapped glass pulverizing device of claim 4, wherein the blanking holes are aligned with a lower part of a hammering end of the vibration hammer, and a size of the blanking holes is more than a maximum width of the hammering end of the vibration hammer.

6. The scrapped glass pulverizing device of claim 2, wherein the scrapped glass pulverizing device further comprises a secondary pulverizing device that pulverizes the scrapped glass pieces generated by the vibration crashing device.

7. The scrapped glass pulverizing device of claim 6, wherein the secondary pulverizing device comprises two crushing gears arranged in parallel and rotated in opposite direction, and crushing teeth of the crushing gears are mutually inserted into grooves between the crushing teeth of the crushing gears at junctions of the two crushing gears.

8. The scrapped glass pulverizing device of claim 7, wherein the crushing platform is configured with blanking holes arranged in an action zone of the vibration hammer; the blanking holes are arranged in a honeycomb net shape on the crushing platform, the blanking holes are aligned with a lower part of a hammering end of the vibration hammer, and a size of the blanking holes is more than a maximum width of the hammering end of the vibration hammer; the secondary pulverizing device is arranged below the crushing platform, and pulverizes the scrapped glass generated by the vibration crashing device and discharged into the secondary pulverizing device through the blanking holes.

9. The scrapped glass pulverizing device of claim 2, wherein the scrapped glass pulverizing device is further configured with a collection container that collects pulverized glass.

* * * * *